US007651044B2

(12) United States Patent
Manola

(10) Patent No.: US 7,651,044 B2
(45) Date of Patent: Jan. 26, 2010

(54) APPARATUS FOR MECHANICALLY PROCESSING DRIED MATERIAL

(75) Inventor: Umberto Manola, Brescia (IT)

(73) Assignee: I.P.H. Limited, Guernsey (GB)

( * ) Notice: Subject to any disclaimer, the term of this patent is extended or adjusted under 35 U.S.C. 154(b) by 0 days.

(21) Appl. No.: 11/402,855

(22) Filed: Apr. 13, 2006

(65) Prior Publication Data

US 2006/0231654 A1 Oct. 19, 2006

(30) Foreign Application Priority Data

Apr. 13, 2005 (EP) ..... 05425221

(51) Int. Cl.
*B02C 1/08* (2006.01)

(52) U.S. Cl. ..... 241/254; 241/286

(58) Field of Classification Search ..... 241/252, 241/253, 257.1, 259.1, 79, 254, 286, 37
See application file for complete search history.

(56) References Cited

U.S. PATENT DOCUMENTS

| | | | | |
|---|---|---|---|---|
| 739,492 | A | 9/1903 | Groves | |
| 2,108,609 | A | 2/1938 | O'Mara | |
| 2,609,150 | A * | 9/1952 | Bludeau | 241/15 |
| 2,886,254 | A | 5/1959 | Rohlinger et al. | |
| 4,113,189 | A | 9/1978 | Sullivan | |
| 4,366,928 | A * | 1/1983 | Hughes | 241/30 |
| 4,477,028 | A * | 10/1984 | Hughes | 241/69 |
| 4,589,923 | A | 5/1986 | Gruenewald | |
| 4,892,258 | A * | 1/1990 | Hughes | 241/79.3 |
| 4,949,915 | A | 8/1990 | Hughes | |
| 5,421,528 | A | 6/1995 | Ronning | |
| 6,435,433 | B1 | 8/2002 | Hesch | |
| 6,631,862 | B2 | 10/2003 | Schilling et al. | |
| 7,118,057 | B2 * | 10/2006 | Hao | 241/228 |

OTHER PUBLICATIONS

European Search Report for EP 05 42 5221 dated Sep. 2, 2005.

* cited by examiner

*Primary Examiner*—Faye Francis
(74) *Attorney, Agent, or Firm*—Nixon & Vanderhye P.C.

(57) ABSTRACT

An apparatus for mechanical processing of materials in the dry state is of the type having a casing, within which are set a plurality of rollers and at least one diffuser and/or contrast element for the plurality of rollers. The casing likewise has at least one input section and at least one output section for the materials. The rollers are arranged around the diffuser and/or contrast element so as to define, for each roller, a gap between the diffuser and/or contrast element and the side surface of the roller, and in that it comprises a drive for setting in rotation the diffuser and/or contrast element with respect to the plurality of rollers and/or for setting in rotation at least one roller, or the entire plurality of rollers, with respect to the diffuser and/or contrast element.

27 Claims, 3 Drawing Sheets

APPARATUS FOR MECHANICALLY PROCESSING DRIED MATERIAL

CROSS REFERENCE TO RELATED APPLICATION

This application is a new U.S. utility application claiming benefit of EP 05425221.8 filed Apr. 13, 2005, the entire contents of which are hereby incorporated by reference.

BACKGROUND OF THE INVENTION

The present invention relates to an apparatus for mechanically processing dried material, preferably, but not exclusively, organic material, of the type in which at least one rotor and one contrast element, functionally associated to the rotor, perform a mechanical action of compression, stretch and/or shear, also through impact, on the organic materials to be processed. Said apparatus is particularly indicated for the extraction of matrices containing active principles starting from organic materials, for example of vegetable origin, in the dry state.

It is to be noted that hereinafter by the term "material in the dry state" or "dried material" is meant any material, of organic or mineral origin, which is substantially devoid of water and may undergo mechanical processing by compression, stretch and/or shear, within a purposely designed apparatus, so that matrices with different principles may be obtained and classified following upon said mechanical processing. A large number of apparatuses are known for the mechanical processing of organic, or inorganic, materials in the dehydrated state, which, via compression, stretch or shear of the materials processed, can for example perform functions of reduction of the starting material into elementary fibres, by shredding, grinding or pulverizing thereof, and extraction of matrices containing just the principles that it is desired to obtain.

At the end of the mechanical processing of the starting materials, there can follow steps of further classification of the mechanically processed materials and possible steps of chemical and/or thermal processing.

The U.S. Pat. No. 2,886,254, filed in the name of Rohlinger, teaches how to obtain a pulverizer for materials of any kind, in which a cylindrical rotor with radial blades is set within a casing that functions as contrast element for the action of the rotor. The casing has an input section for introduction of the starting material that is shaped in such a way as to enable inflow of said material in a position corresponding to the axis of the rotor.

The U.S. Pat. No. 5,421,528, filed in the name of Ronning, describes a mechanical fractioning device for dry organic materials, in which a cylindrical rotor with radial blades acts within a casing, which has an input section for introduction of the starting material that is set in such a way as to enable inflow of the material in a radial direction with respect to the rotor.

The U.S. Pat. No. 6,435,433, filed in the name of Hesch, relates to a device for disintegrating substances and compounds comprising fibres, having a casing within which is set a rotor equipped with radial blades arranged in such a way as to define a cavity, within which the material to be processed is received.

The U.S. Pat. No. 4,589,923, filed in the name of Gruenewald, relates to a device for the mechanical processing of fibrous materials, in which two counter-rotating rollers within a purposely designed casing compress between them the material that flows in a direction orthogonal to the axes of the two rollers.

The U.S. Pat. No. 6,631,862, filed in the name of Schilling, describes an apparatus for disintegrating organic material, in which a rotor has a number of arms parallel to the axis of the rotor and with an indented side surface, which rotate within a circular stator. The stator is also provided with an indented internal surface that is set facing the surface of the arms, with a certain gap between arms and stator. The apparatuses of the known art, an overview of which is provided above without any claim to being exhaustive, are subject to a certain number of drawbacks and disadvantages.

In the first place, the known apparatuses present a considerable rigidity of use, proving suitable only for a certain type of starting material, but far from adaptable to materials having physical characteristics different from the ones for which the apparatus was devised.

Furthermore, apparatuses of the known art are far from suitable for producing, from the starting material, classifiable matrices, i.e., matrices of products in which the various principles that are intended to be obtained following upon processing are well separated or separable.

In the case, then, where the apparatuses known to the art are used for the extraction of matrices containing active principles, of the type for example usable in the pharmaceutical, cosmetics or foodstuffs fields, starting from organic materials in the dry state, it is found that the matrices obtained starting from said known apparatuses do not have a high degree of purity of the active principles, and likewise that said active principles contained in the matrices do not present a good stability. In addition, the use of the known apparatuses for obtaining matrices with active principles entails the generation of a high amount of waste of the starting material.

SUMMARY OF THE INVENTION

It is consequently a purpose of the present invention to provide an apparatus for the mechanical processing of materials, preferably organic materials in the dry state, which does not present the disadvantages of the prior art.

Consequently, a purpose of the apparatus according to the present invention is that of mechanical processing of materials, preferably dry organic ones, in such a way that the matrices of material obtained following upon processing are easily classifiable and high levels of production waste are avoided.

Another purpose of the present invention is to provide an apparatus which, starting from organic material in the dry state, will enable matrices having high percentages of active principles to be obtained, with a high stability and purity of the latter.

Yet another purpose of the present invention is to provide an apparatus for the processing of dry material that will present a high adaptablity to the different starting materials that it is intended to process.

The above and other purposes are achieved by the apparatus according to the first independent claim and the subsequent dependent claims.

According to the present invention, the apparatus for mechanical processing of materials in the dry state comprises a casing equipped with an input section and an output section for the dry material, inside which are set a plurality of rollers, preferably with axes parallel to one another, and at least one diffuser and/or contrast element for said plurality of rollers. The rollers are arranged around the diffuser and/or contrast element so as to define, for each roller, a gap, either fixed or variable, between the diffuser and/or contrast element and the side surface of each roller. In addition, the apparatus comprises means for setting the diffuser and/or contrast element in rotation with respect to the aforesaid plurality of rollers, and/or means for setting at least one roller or the entire plurality of rollers in rotation with respect to the diffuser and/or contrast element.

It has been found that the particular orbital arrangement of the rollers around the diffuser and/or contrast element enables exertion on the dry starting material, during the relative rotation of the diffuser element with respect to the rollers, or vice versa, a mechanical action capable of breaking the starting material down in an optimal way into matrices having different geometrical and biochemical characteristics, containing the desired principles from said starting material.

According to a preferred aspect of the present invention, the rollers can be removable, and hence interchangeable, so as to enable the use of rollers having side surfaces with different conformation or roughness, and the gap between each roller and the diffuser and/or contrast element can be varied by the user. Also the aforesaid diffuser and/or contrast element can be mounted in the casing in a removable way. In this way, it is possible to adapt the apparatus of the present invention easily to use with starting materials having different physical, geometrical and/or biochemical characteristics.

According to another aspect of the present invention, the diffuser and/or contrast element comprises a cylindrical portion having an axis parallel to the axes of the rollers, in the case where said axes of the rollers are parallel to one another, and a side surface facing, at least in part, the side surfaces of the rollers themselves, and the aforesaid rollers can have at least one portion of the external side surface thereof with surface characteristics different from those of the remaining part of the side surface. In particular, said portions of the side surface of the rollers can regard regions of the side surface extending throughout the length of the rollers themselves.

The apparatus can likewise comprise means for blocking at least one roller with said different surface portions in a given angular position with respect to the aforesaid diffuser and/or contrast element.

Thus, the user can, by simply rotating the rollers about their own axis and fixing them in their desired angular position, force a certain surface of the roller with appropriate geometrical and surface characteristics to set itself facing the diffuser and/or contrast element, thus varying the conditions of the mechanical action exerted by the apparatus on the starting material.

In a preferred embodiment of the apparatus according to the present invention, moreover, the input section for the starting material of the casing is shaped for introducing the starting material within the apparatus in the same direction as that of the axis of the diffuser and/or contrast element.

According to a further aspect of the present invention, the apparatus also comprises, downstream of the output section of the casing, one or more devices for classification of the material processed, such as for example separator cyclones or filters.

BRIEF DESCRIPTION OF THE DRAWINGS

There will now be described, purely by way of non-limiting example, some preferred embodiments of the apparatus of the present invention, with reference to the attached figures, wherein.

DETAILED DESCRIPTION OF EMBODIMENTS

Figure 1:
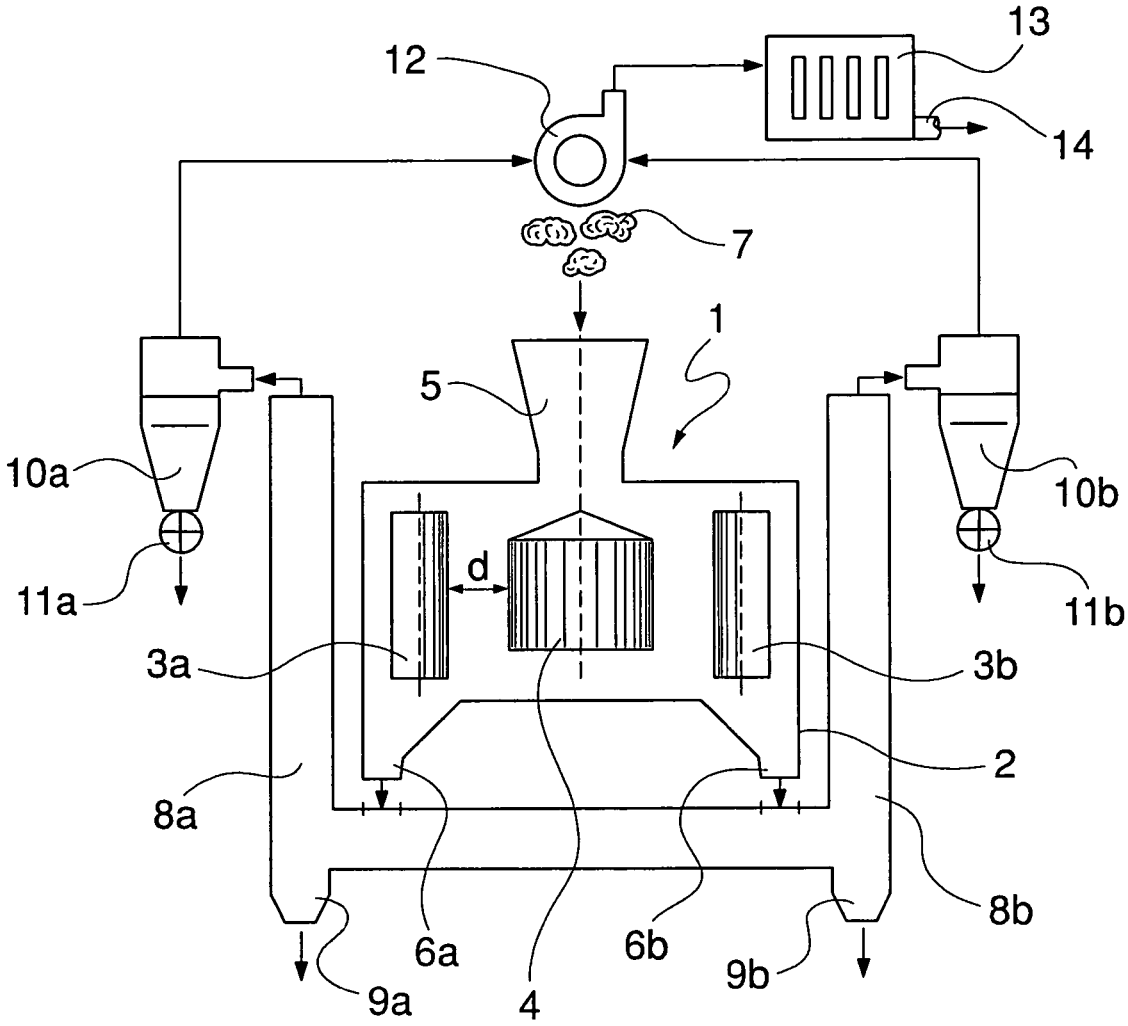
FIG. 1 is a diagram of an apparatus according to a particular aspect of the present invention.
Figure 2:
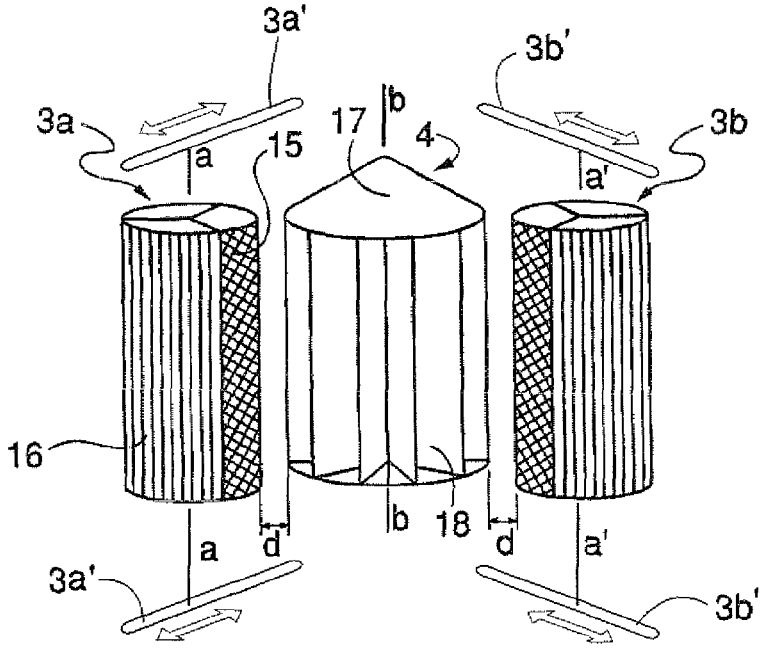
FIG. 2 is a schematic cutaway side view of a diffuser and/or contrast element surrounded by two rollers, according to another aspect of the present invention.

With reference to the figures as a whole, the apparatus 1 for the mechanical processing of materials 7 in the dry state comprises a casing 2 having an input section 5 for the starting material 7, set at the top, and two output sections 6*a*, 6*b*, set at the bottom.

Housed within the casing 2 is a diffuser and/or contrast element 4 for the starting material and a plurality of rollers 3, which are advantageously set around said diffuser and/or contrast element 4 in such a way that the side surface of each roller 3*a*, 3*b* of the plurality of rollers 3 defines, with said element 4, a gap "d" for passage of the material to be processed.

The apparatus of the present invention likewise comprises means (not illustrated) for setting the diffuser and/or contrast element 4 in rotation with respect to the plurality of rollers 3, and/or for setting in rotation at least one roller 3*a*, 3*b*, or the entire plurality of rollers 3, with respect to the diffuser and/or contrast element 4.

Figure 4:
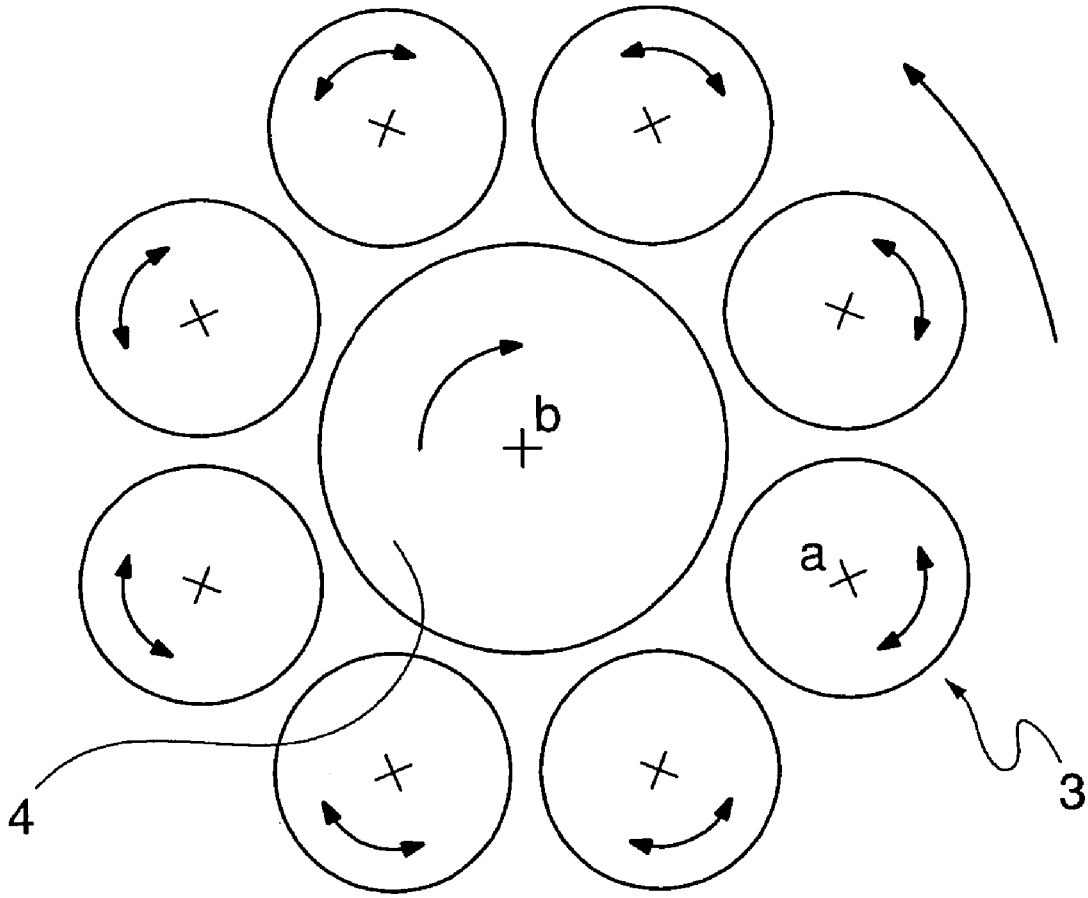
FIG. 4 is a schematic view from above of a diffuser and/or contrast element surrounded by a plurality of rollers, with the possible directions of rotation of the various members indicated.

Said means, which can comprise electric motors, automatic controllers, drive shafts for transmission of motion, driving gear, etc., can thus actuate the element 4 and/or the rollers 3*a*, 3*b* according to at least one of the modalities illustrated schematically in FIG. 4.

According to a preferred aspect of the present invention, the apparatus 1 could be equipped just with means for setting in rotation the element 4 and be devoid of means for actuating the plurality of rollers 3. The diffuser and/or contrast element 4 could thus be set in rotation about its own axis b-b, and the plurality of rollers 3, as a whole, might not present an orbital movement about the element 4 and could be fixed with respect to the casing 2.

However, in a preferred embodiment of the apparatus 1 according to the present invention, the rollers 3*a*, 3*b* could be set individually in rotation about their own axis a-a, by purposely provided means (not illustrated), in a direction opposite to the direction of rotation of the element 4.

Figure 3:
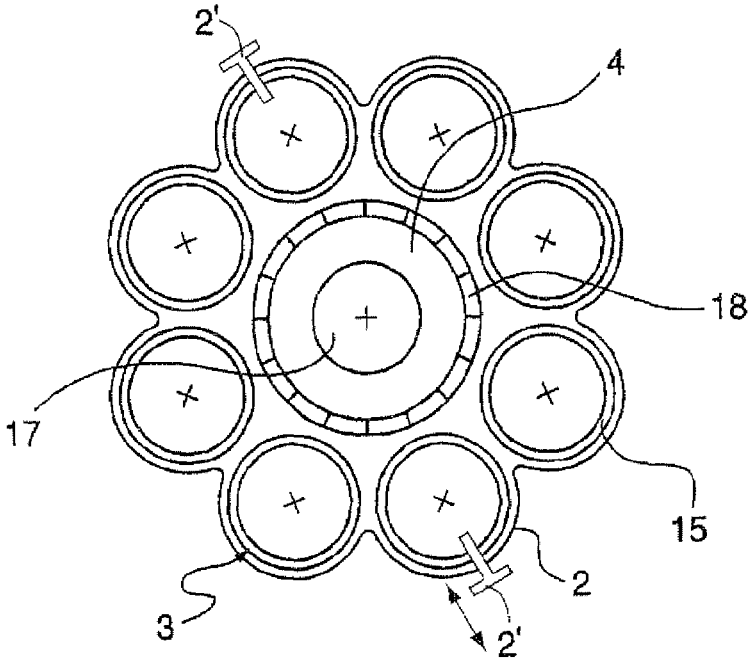
FIG. 3 is a schematic cross-sectional view from above of a diffuser and/or contrast element surrounded by a plurality of rollers of the apparatus of FIG. 1.

Whether the rollers 3*a*, 3*b* are altogether fixed with respect to the casing 2 or said rollers 3*a*, 3*b* are, instead, rotatable about their own axis a-a, the casing 2 could be shaped so as to conform to the external profile dictated by the plurality of rollers 3, as may be seen in FIG. 3.

Alternatively, the apparatus 1 might not comprise the aforesaid means for setting in rotation the element 4, but only the means for actuating the plurality of rollers 3 orbitally around the aforesaid diffuser and/or contrast element 4, and hence all the rollers 3*a*, 3*b* of the aforesaid plurality of rollers 3 could be set in rotation about the axis b-b of the element 4, necessarily fixed with respect to the casing 2.

This particular modality of operation could be desirable In the case where the diffuser and/or contrast element 4 were constituted by a fixed ring nut (not illustrated), shaped and set in such a way as to have a side surface thereof engaged, at least partially, with the side surface of the rollers 3*a*, 3*b*.

In this case, the external casing 2 of the apparatus 1 should be shaped in such a way as to enable rotation of the plurality of rollers with respect to the axis b-b of the element 4. For example, the casing 2 can be cylindrical with a circular right section.

According to another aspect of the present invention, the apparatus 1 could comprise means for setting in rotation, with respect to the casing 2, both the plurality of rollers 3 and the diffuser and/or contrast element 4. In this case, as represented schematically in FIG. 4, the direction of rotation of the element 4 can be opposite to the direction of rotation imposed on the plurality of rollers 3 so as to enable, albeit with a speed of rotation of the rollers 3*a*, 3*b* and of the element 4 that is not high, a considerable relative speed between said rollers 3*a*, 3*b* and the element 4.

The relative speed of rotation of the element 4 with respect to the rollers 3*a*, 3*b*, or vice versa, can be between 500 r.p.m. and 23 000 r.p.m., as a function of the material to be processed.

As already mentioned, irrespective of the modalities of actuation of the element 4 and of the rollers 3*a*, 3*b*, each roller 3*a*, 3*b* of the plurality of rollers 3 can be rotatable about its own axis a-a. In this connection, the apparatus 1 could comprise means for actuating in rotation, with respect to their own axis a-a, said rollers 3*a*, 3*b* individually with respect to the diffuser and/or contrast element 4. Also in this case, the direction of rotation of the rollers 3*a*, 3*b* could to advantage be opposite to the direction of rotation of the element 4, in the case where the latter were to be actuated by purposely provided means.

Alternatively, one or more of the rollers 3*a*, 3*b*, or the entire plurality of rollers 3, which are rotatable about their own respective axis a-a, can be mounted idle within the casing 2 so as to oppose a limited resistance to the material 7 during rotation of the diffuser and/or contrast element 4.

It is to be noted that, even though the figures show rollers 3*a*, 3*b* of a cylindrical shape, said rollers 3*a*, 3*b* could alternatively have, for example, a conical shape or be shaped like a truncated cone or be twisted cylinders, or else have any appropriate shape provided that they are rotatable about the axis a-a. In the latter case, by "side surface" of the rollers 3*a*, 3*b* is meant the surface of the rollers that is set so as to be functionally coupled to the element 4.

It is to be moreover noted that the shape of the rollers 3*a*, 3*b* could be the same or could vary from roller to roller within the plurality of rollers 3.

In a similar way, even though in the figures the shape of the element 4 is constituted by a cylindrical portion, surmounted by a conical portion or portion shaped like a truncated cone 17, any other appropriate shape could be used for diffusion and for mechanical processing of the starting dry materials 7. Thus, for example, the diffuser and/or contrast element 4 could be a cylindrical ring nut having the side surface thereof shaped so as to follow the profile of the side surface of the plurality of rollers 3, mobile or fixed with respect to the casing 2.

In the embodiment illustrated in the figures, the rollers 3*a*, 3*b* can be arranged in the casing 2 in such a way that their respective axes a-a are parallel to one another and are arranged substantially along a circumference (see FIGS. 3 and 4). Said conformation enables a considerable structural simplification of the device.

According to a preferred aspect of the present invention, as already mentioned, the diffuser and/or contrast element 4 comprises a cylindrical portion, surmounted by a conical portion, or portion shaped like a truncated cone, 17, the side surface of which faces, at least in part, the side surface of the rollers 3*a*, 3*b*. In the embodiment illustrated, the cylindrical portion of the element 4 comprises a plurality of blades 18, parallel to the axis b-b of the element 4, and arranged radially with respect to said axis b-b.

The input section 5 for introduction of the material to be processed can be shaped and set on the casing 2 in such a way as to enable inflow of the material in directions parallel to the axis b-b of the element 4, and/or of the axes a-a of the rollers 3*a*, 3*b*, when they are parallel to one another, preferably in a position corresponding to the aforementioned conical portion or portion shaped like a truncated cone 17 of the same element 4.

In a preferred embodiment of the present invention, each roller 3*a*, 3*b* of the plurality of rollers 3 is mounted within the casing 2 in a removable way so as to enable its replacement as a function of the starting material in the dry state or when, on account of the wear that occurs during operation of the apparatus, it is necessary to mount a new roller 3*a*, 3*b*.

Also the diffuser and/or contrast element 4 can be removably mounted within the casing 2 so as to enable convenient replacement thereof.

The rollers 3*a*, 3*b* can likewise be mounted in the casing 2 on guides 3*a*', 3*b*' that enable their radial displacement with respect to the diffuser and/or contrast element 4 and their subsequent fixing in the desired position. This enables variation of the gap "d" between each roller 3*a*, 3*b* and the active surface of the element 4 in such a way as to adapt the apparatus 1 to materials having different physical, geometrical and chemical characteristics. The gap "d" between the rollers 3*a*, 3*b* and the element 4 can be comprised in the range of 0.1-40 mm.

According to a preferred aspect of the present invention, the side surface of the rollers 3*a*, 3*b* can present regions 15, 16, preferably extending throughout the length of each roller 3*a*, 3*b*, having surface characteristics different from one another. For example, the rollers 3*a*, 3*b* can present knurled regions 15, 16 or regions with spikes, or be indented, smooth with high roughness or smooth with low roughness, etc.

In the case where the rollers 3*a*, 3*b* were not set in rotation by actuation means and in the case where they presented different surface regions extending throughout their length, it could be desirable to keep a given surface region 15, 16 of each roller 3*a*, 3*b* facing the active surface of the diffuser and/or contrast element 4 as a function of the angular position in which each roller 3*a*, 3*b* is set with respect to said element 4.

In this case, the apparatus 1 could be equipped with appropriate members 2' for blocking the angular position of each roller 3*a*, 3*b* about its own axis a-a, with respect to the element 4.

Thus, according to this embodiment, the user of the apparatus 1 could decide which surface region 15, 16 of each roller 3*a*, 3*b* to keep facing the active surface, i.e., functionally coupled to the side surfaces of the rollers 3*a*, 3*b*, of the element 4 as a function of the action that the apparatus 1 should exert on the starting material 7.

The particular apparatus 1 illustrated in FIG. 1, which is usable preferably for extraction and classification of matrices containing active principles starting from organic material 7 in the dry state, can likewise comprise a plurality of members for the classification/selection of the material at output from the sections 6*a*, 6*b* of the casing 2, such as for example ascending panels with angled sections 8*a*, 8*b*, subject to a suction flow generated in a controlled way by an appropriate aspirator 12 and equipped with output sections 9*a*, 9*b*, separator cyclones 10*a*, 10*b*, with output sections 11*a*, 11*b*, and filters 13, for example vibrating screens, with output sections 14.

Said classification members enable optimal selection of the different matrices at output from the casing 2 after mechanical processing due to the element 4 and to the plurality of rollers 3.

The operation of the apparatus 1 illustrated herein envisages that the user, as a function of the starting material 7 and what he wishes to obtain at the end of the mechanical processing, will choose and install within the casing 2 the rollers 3*a*, 3*b* and the diffuser and/or contrast element 4 that are most appropriate, deciding in particular both the number of rollers 3*a*, 3*b* and the surface conformation thereof and of the element 4, as well as the gap "d" that is to be left between the element 4 and the side surfaces of the rollers 3*a*, 3*b*.

At this point, after setting the conditions of rotation, i.e., the angular velocities, of the rollers 3*a*, 3*b* and/or of the plurality of rollers 3, and/or of the element 4, that he considers suitable for the material 7, the user introduces the material 7 within the casing 2 via the input section 5.

The material 7, thanks to the arrangement of the input section 5 with respect to the element 4, as it falls strikes the conical portion 17 of said element 4 and is thus deflected into the space that extends between the cylindrical portion, preferably with blades 18, of the element 4 and the side surfaces of the rollers 3*a*, 3*b*, within the gap "d" between the rollers 3*a*, 3*b* and the diffuser and/or contrast element 4. The relative rotation of the rollers 3*a*, 3*b* with respect to the element 4 enables mechanical processing of said material 7, which is thus reduced into matrices at the output sections 6*a*, 6*b* of the casing 2.

From here, in the particular embodiment of FIG. 1, the matrices are further classified by the members 8*a*, 8*b*, 10*a*, 10*b*, 12 and 13 and are hence available to the user of the apparatus 1, in a precisely selected way. In other words, at output from the apparatus 1, it is possible to obtain a set of matrices well separated from one another, each of which contains in an extremely pure and exclusive way only one or some of the principles present in the starting material 7.

The invention claimed is:

1. An apparatus for the mechanical processing of materials in the dry state, said apparatus comprising a casing, within which are set a plurality of rollers and at least one common element for said plurality of rollers, said common element comprising a diffuser element, a contrast element or a combined diffuser and contrast element, said casing having at least one input section and at least one output section for said materials, wherein said plurality of rollers are arranged around said common element so as to define, for each roller of said plurality of rollers, a gap between said common element and the side surface of said roller, and wherein the apparatus further comprises means for setting in rotation said common element with respect to said plurality of rollers and/or for setting in rotation at least one roller of said plurality of rollers with respect to said common element; and means for varying the gap between at least one roller of said plurality of rollers and said common element, said means for varying said gap comprising at least one guide mounted in the casing, said at least one roller being movable on the at least one guide such that the at least one roller is movable radially towards and away from said common element.

2. The apparatus according to claim 1, wherein said common element is fixed with respect to the casing and said plurality of rollers is rotatable with respect to said common element, or vice versa.

3. The apparatus according to claim 1, wherein said common element and said plurality of rollers are rotatable with respect to said casing and said plurality of rollers is rotatable in the direction opposite to the direction of rotation of said common element.

4. The apparatus according to claim 1, wherein said rollers are configured to rotate orbitally around said common element.

5. The apparatus according to claim 1, wherein each of said rollers is rotatable around its own axis.

6. The apparatus according to claim 1, wherein said rollers have their own axes parallel to one another and said input section of said casing is shaped for introducing organic material in a direction substantially parallel to the axes of said plurality of rollers.

7. The apparatus according to claim 6, wherein said input section for the material in the dry state of said casing is shaped for introducing said material in the dry state within said casing in the same direction as the axis of said common element.

8. The apparatus according to claim 7, wherein said common element comprises at least one conical portion or a portion having the shape of a truncated cone set in a position corresponding to said input section.

9. The apparatus according to claim 1, wherein said common element comprises at least one cylindrical portion having an axis parallel to the axes of said plurality of rollers and a side surface facing, at least in part, the side surface of said rollers.

10. The apparatus according to claim 9, wherein said at least one cylindrical portion of said common element comprises one or more blades parallel to the axis of said cylindrical portion.

11. The apparatus according to claim 1, wherein said common element comprises a grating having a side surface facing, at least in part, the side surface of the rollers of said plurality of rollers.

12. The apparatus according to claim 1, wherein at least one roller of said plurality of rollers is removably mounted within said casing.

13. The apparatus according to claim 1, wherein at least one roller of said plurality of rollers has one or more portions of the external side surface thereof having surface characteristics different from those of the remaining part of the side surface.

14. The apparatus according to claim 13, wherein said at least one roller of said plurality of rollers is mobile for presenting selectively said one or more portions of the external side surface thereof facing said common element.

15. The apparatus according to claim 13, wherein said one or more portions of the external side surface of at least one roller of said plurality of rollers having surface characteristics different from those of the remaining part of the side surface extend throughout the length of said roller.

16. The apparatus according to claim 13, further comprising member to lock said at least one roller in a given angular position, with respect to said common element.

17. The apparatus according to claim 1, wherein said means for varying the gap between at least one roller and said common element vary said gap in a range of between 0.1-40 mm.

18. The apparatus according to claim 1, in which said common element is structured to rotate relatively with respect to said casing at a rate of between 500 r.p.m. and 23 000 r.p.m.

19. The apparatus according to claim 1, further comprising downstream of said output section of said casing, one or more devices for the classification of matrices obtained.

20. The apparatus according to claim 1, wherein the gap between each of said rollers and the common element is variable.

21. An apparatus for the mechanical processing of materials in the dry state, said apparatus comprising a casing, within which are set a plurality of rollers and at least one common element for said plurality of rollers, said common element comprising a diffuser element, a contrast element or a combined diffuser and contrast element, said casing having at least one input section and at least one output section for said materials, wherein said plurality of rollers are arranged around said common element so as to define, for each roller of said plurality of rollers, a gap between said common element and the side surface of said roller, and wherein the apparatus further comprises a drive to rotate said common element with respect to said plurality of rollers and/or to rotate at least one roller of said plurality of rollers with respect to said common element, and an adjustment device to vary the gap between at least one roller of said plurality of rollers and said common element, said adjustment device including at least one guide mounted in the casing, said at least one roller being movable on the at least one guide such that the at least one roller is movable radially towards and away from said common element.

22. The apparatus according to claim 21, further comprising a member to set the at least one roller in a given angular position.

23. The apparatus according to claim 21, wherein the gap between each of said rollers and the common element is variable.

24. An apparatus for the mechanical processing of material in the dry state, said apparatus comprising a casing, within which are set a plurality of rollers and at least one common element for said plurality of rollers, said common element comprising a diffuser element, a contrast element or a combined diffuser and contrast element, said casing having at least one input section and at least one output section for said materials, wherein said plurality of rollers are arranged around said common element so as to define, for each roller of said plurality of rollers, a gap between said common element and the side surface of said roller, and wherein the apparatus further comprises a drive to set in rotation said common element with respect to said plurality of rollers and/or for setting in rotation at least one roller of said plurality of rollers with respect to said common element, wherein at least one roller is radially displaceable with respect to said common element to vary the gap between said at least one roller and said common element.

25. The apparatus according to claim 24, wherein the at least one roller is slidable with respect to the common element to vary the gap.

26. The apparatus according to claim 24, wherein the at least one roller is slidable towards and away from the common element.

27. The apparatus according to claim 24, wherein the gap between each of said rollers and the common element is variable.

* * * * *